United States Patent [19]

Haythornthwaite

[11] Patent Number: 4,721,222

[45] Date of Patent: Jan. 26, 1988

[54] COMBINATION BEVERAGE CAN CARRIER DEVICE AND DRINKING ACCESSORY

[76] Inventor: James Haythornthwaite, 567 Main Road, Hudson, Quebec, Canada, J0P 1J0

[21] Appl. No.: 890,858

[22] Filed: Jul. 31, 1986

[51] Int. Cl.[4] ..... B65D 21/02; A47G 19/22

[52] U.S. Cl. ..... 220/234; 206/151; 220/90.2

[58] Field of Search ..... 220/23.4, 90.2; 206/151

[56] References Cited

U.S. PATENT DOCUMENTS

| | | | |
|---|---|---|---|
| 2,075,721 | 3/1937 | Hommel . | |
| 2,729,956 | 1/1956 | Gilbert | 220/90.2 |
| 3,185,341 | 5/1965 | Barbour . | |
| 3,202,448 | 8/1965 | Stern | 206/151 |
| 3,350,131 | 10/1967 | Tanzer | 206/151 |
| 3,397,003 | 8/1968 | Wherry | 220/23.4 |
| 3,664,497 | 5/1972 | Mascia | 206/151 |
| 4,054,205 | 10/1977 | Blow, Jr. et al. . | |

FOREIGN PATENT DOCUMENTS

| | | | |
|---|---|---|---|
| 1490673 | 6/1967 | France | 206/151 |
| 864155 | 3/1961 | United Kingdom | 220/90.2 |

*Primary Examiner*—George E. Lowrance

*Attorney, Agent, or Firm*—Fleit, Jacobson, Cohn & Price

[57] ABSTRACT

A combination beverage can carrier device and drinking accessory is disclosed. The device comprises a plurality of releasably detachable hollow cylindrical extension members which are connected to each other in parallel rows to form a carrier to be used in connection with beverage cans. When used as a carrier, the extensions are mounted flush to the top rim of the cans. Each extension is readily detachable from each other, and when detached, the extension can form a drinking accessory, such as a cup. When detached, the extension is telescopically slid upwardly along the outer surface of a can so that the top of the extension projects beyond the top rim of the can. This arrangement allows the user to directly drink from the can without touching his or her lips to the metallic surface and thereby increase safety and hygiene. Further, the extension and top surface of the can creates an area whereby external additives, such as ice cubes may be added. Once the consumer has finished the beverage, the can and member may be simultaneously discarded or recycled.

9 Claims, 4 Drawing Figures

COMBINATION BEVERAGE CAN CARRIER DEVICE AND DRINKING ACCESSORY

BACKGROUND OF THE INVENTION

1. Field of the Invention

This invention relates to accessories to be used in connection with beverage cans, more specifically, to a combination beverage can carrier device and drinking accessory.

2. Description of Prior Art

Modern cans for storing beverages, such as soda or beer, typically contain snap top openers which are pulled to gain access to the contents of the cans. The opening remaining after the opener has been be pulled can have sharp edges. A consumer therefore can be subject to potential danger when drinking directly from the can because of the sharp edges.

To reduce potential health hazards, auxiliary devices, such as cups, glasses or straws have been used in connection with beverage cans, but if such devices are not present, the consumer has no choice but to drink from the cans themselves.

Carrying beverage cans also can pose problems to the consumer. Typically, unless a carrying container is provided, a consumer cannot carry more than one or two cans in his or her hand at a given time. Therefore, containers which house more than one can have been invented, most notably the so called "six pack" which consists of molded plastic designed to house six cans in two parallel rows of three cans per row. Although the "six pack" has been of great value to the consumer with respect to handling and shipping, the "six pack" does not alleviate problems caused by the sharp edges in the opening to the can if the consumer chooses to drink from the can itself.

Prior to the present invention, no invention has been developed which can provide the consumer with the two-fold benefit of safe drinking from a beverage can without the use of an auxiliary device, combined with the convenience of a carrier device.

U.S. Pat. No. 2,075,721 to Hommel, U.S. Pat. No. 2,729,956 to Gilbert, U.S. Pat. No. 3,185,341 to Barbour, and U.S. Pat. No. 4,054,205 to Blow, Jr. et al., disclose respective attachments adapted to be mounted onto the upper end of a can to serve as an extended drinking lip so that the user does not directly touch his or her lips to the can when drinking. None of these patents disclose an attachment that is an integral part of a convenience carrier package, such as a carrier for six cans.

U.S. Pat. Nos. 3,202,448 to Stern et al., and 3,350,131 to Tanzer, disclose combined carrying units and coasters. In these patents, the carrying unit contains respective members which are adapted to fit over the top of a can and are detachable from each other so that each top is removed with each can. The covering which covers the top of the can is solid. In one embodiment in U.S. Pat. No. 3,350,131 to Tanzer, the top may be used as a drinking cup. However, this arrangement is obtained only when the top is physically removed from the can, is inverted and when the contents of the can are then poured into the cup. This arrangement is inconvenient in that the cup must be physically separated from the can to effectuate its use.

Therefore, there exists a need for a combination beverage drinking can accessory and carrier device whereby an accessory designed to be mounted onto the top of the can may be used to provide a lip for drinking the contents of the can without requiring the consumer to touch his or her lips to the can and without removing the attachment from the can, and where a plurality of accessories may be combined to form a carrier to allow the consumer the convenience of carrying several cans in one hand.

SUMMARY OF THE INVENTION

Thus, a purpose of the present invention is to provide a combination beverage can accessory and carrier device whereby the individual components of the carrier device may be converted to form a drinking cup for use when consuming a beverage contained in a can. The device is designed so that each drinking accessory is mounted flush to the upper lip of a beverage can when the apparatus of the present invention is to be used as a carrier. If an individual chooses to drink from the beverage can, the cup which surrounds the top of the can, and which forms part of the carrier is releasably detached from the other cans and members so that the consumer has one can with the cup mounted flush to the top of the can. To use the cup as a drinking accessory, it is telescopically slid up the side of the can until its lower surface engages with the upper rim of the can. This arrangement then allows the consumer to drink from the can, without having to press his or her lips against the metallic surface of the can.

Thus, it is an object of the present invention to provide a combination beverage drinking can accessory and carrier device whereby the accessory is used as a cup which has a smooth drinking surface without requiring the accessory to be externally removed from the can.

It is a further object of the present invention to provide a combination drinking can accessory and carrier device whereby a multiple number of drinking can accessories are formed together in parallel rows to obtain a carrier device.

A further object of the present invention is to provide a combination drinking can accessory and carrier device whereby the top of each accessory is mounted flush to the upper rim of the can when the accessories are used as a carrier.

It is an additional object of the present invention to provide an accessory to prevent an individual from being sprayed with liquid upon opening the top of a can.

Other objects and features of the present invention will become apparent to those skilled in the art as the disclosure is made in the following description of the preferred embodiment of the present invention, as illustrated in the accompanying drawings.

DETAILED DESCRIPTION OF THE DRAWINGS

Figure 1:
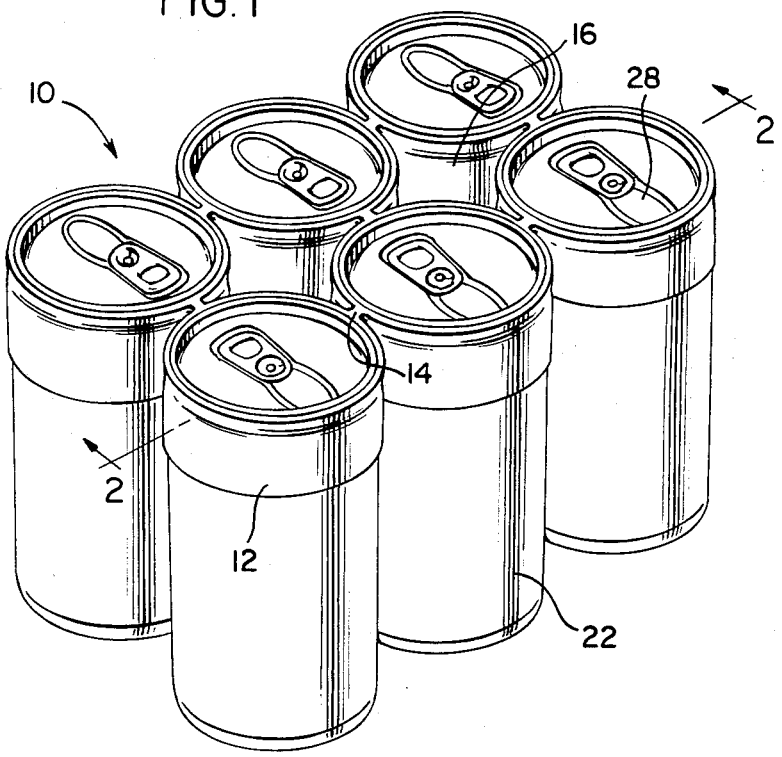
FIG. 1 is a perspective view of a combination beverage drinking can accessory and carrier device embodying the teachings of the instant invention when the device is used as a carrier.

In describing the invention illustrated in the drawings, specific terminology will be resorted to for the sake of clarity. However, the invention is not intended to be limited to the specific terms so selected, and it is to be understood that each specific term selected includes all technical equivalents which operate in a similar manner to accomplish a similar purpose.

Referring now to the drawings, and more particularly FIG. 1, the basic elements of the combination beverage can carrier device and drinking accessory of the present invention are collectively designated as 10. Device 10 is made of a one mold formation, and preferably is made of plastic. Device 10 is formed by the connection of a multiple number of hollow cylindrical sleeve-like extensions or cups 12. Each extension 12 is sized so that its inside circumferential surface can fit snugly around the surface of a can 22, such as a twelve ounce can. In the preferred embodiment of the present invention, six such extensions 12 are used and are connected in two parallel rows of three extensions per row.

Extensions 12 are connected to each other by weakened intersection regions 14 which are located along the upper outer surfaces of extensions 12. Regions 14 are preferably made of the same plastic as extensions 12 but are more thin, perforated or indented so that they may easily be fractured in preference to other areas of the extensions 12.

The connection of extensions 12 by regions 14, defines openings 16 when four extensions 12 are connected in a square or rectangular formation. The openings 16 are located at the center of the square or rectangular formation. In the preferred embodiment of the present invention, by using six extensions 12 in two parallel rows of three extensions per row, two such openings 16 will be produced. The fingers of the individual may be inserted into openings 16 so that device 10, and the cans that it secures, may be carried in one hand.

Figure 2:
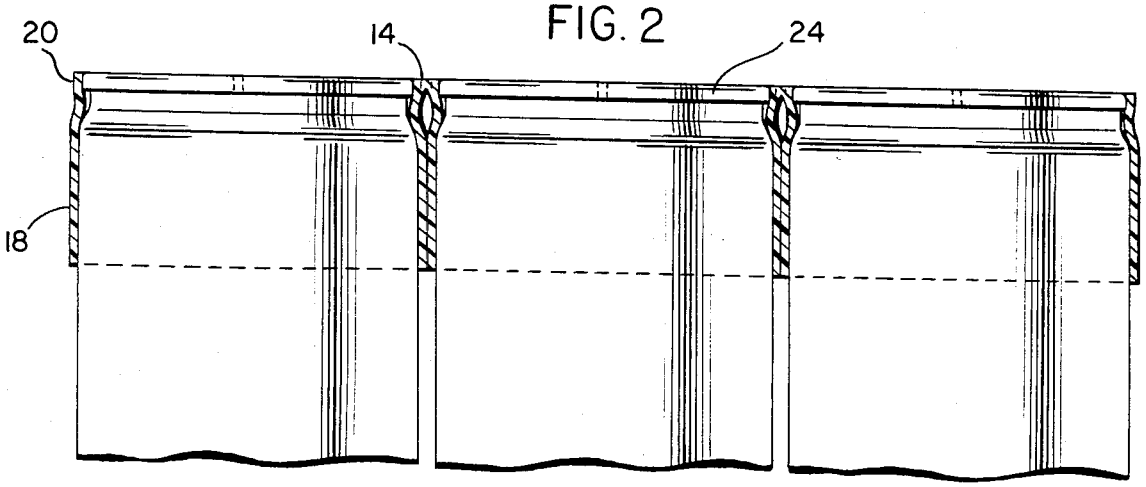
FIG. 2 is a view taken along line 2—2 of FIG. 1.

Device 10 is mounted onto cans 22 in any suitable fashion. In the preferred mounting arrangement, the top edge 20 of extension 12 should be mounted flush with the upper rim of a can 24. The length of each extension 12 should not be longer than the length of its corresponding can 22. Further, due to the mounting arrangement, lower surface 18 of accessory 12 is engaged with the outer surface of can 22 so that it rests flush against can 22. By this arrangement, the frictional forces asserted on can 22 by edge 20 and surface 18, allows an individual to transport cans 22 by means of holder 10 and openings 16 without longitudinally displacing extensions 12 from the upper surfaces of cans 22. The dual frictional force assembly is pictured in FIG. 2.

To remove a can 22 and its associated extension 12 from holder 10, the consumer applies a force sufficient to fracture weakened regions 14 by pulling the can away from its neighboring cans remaining in device 10. Removal of one such can and extension will not affect the other cans or other extensions as the remainder of device 10 will be intact. Once a can 22 and extension 12 have been removed from device 10, an individual can use accessory 12 as an aid in drinking a beverage from can 26.

To use extension 12 as a drinking accessory, extension 12 is telescopically slid longitudinally along the outer surface of can 22 so that the top edge 20 of extension 12 projects above the surface of rim 24. To accomplish this, the user presses upwardly with a force sufficient to overcome the frictional forces exerted on can 22 by surface 18 and edge 20.

Figure 3:
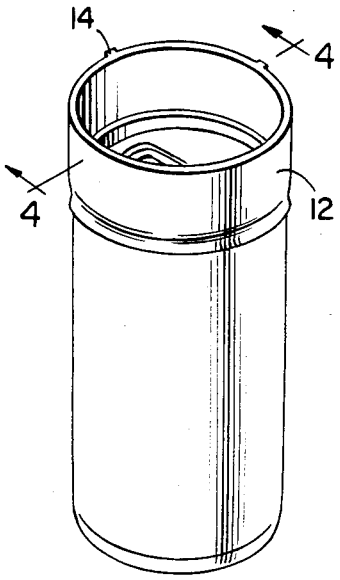
FIG. 3 is a perspective view of a can and cup when the cup is in its elevated position.
Figure 4:
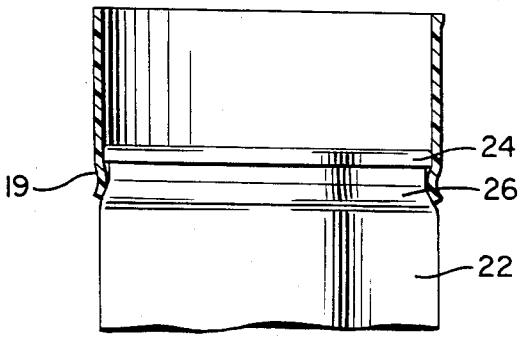
FIG. 4 is a view taken along line 4—4 of FIG. 3.

When extension 12 is fully extended above can 22, the overall length of the can 22 and extension 12 assembly should approximate the length of the can 26 and the length of extension 12, less an amount which overlaps between the two. This result is shown in FIG. 3 in perspective, and in FIG. 4 in cross section. Referring to FIG. 4, when extension 12 is fully extended, the bottom portion 19 of extension 12 is located in the depressed top area 26 of can 22 just below rim 24 which is where the circumference at area 26 is less than the circumference of rim 24. While not illustrated, extension 12 can be provided with an internal bead or other locking mechanism to engage smaller-circumference area 26.

After extension 12 has been raised as shown in FIG. 3, can 22 may be opened by typical means, such as top opener 28. When opening can 22, the user is protected from spurting liquid because the liquid will be deflected by the inner surface of extension 12.

After opening the can, the consumer can consume the contents without touching the metal surfaces of the can by use of extension 12 as a cup. Once the consumer has fully consumed the beverage in can 22, can 22 and extension 12 may be discarded or recycled.

Further, ice cubes, lemon slices, etc., may be placed inside extension 12 so that when the consumer drinks from can 22, the liquid will be chilled and/or flavored upon contact with the contents of the extension.

In addition, by designing accessory 12 to be made from plastic, when an individual consumes a beverage from can 22, the individual will not be subject to having his or her lips adhere to the metallic surface of the can. This is especially advantageous when the consumer is in a cold climate, such as a winter carnival or a football game.

From the above, it should be apparent that many modifications and variations of the present invention are possible. It is therefore to be understood that, within the scope of the appended claims, the invention may be practiced otherwise than as is specifically described.

What is claimed is:

1. A combination beverage can carrier device and drinking accessory comprising:

a plurality of releasably detachable connected hollow cylindrical shaped extension members, each sized so that its inside circumferential surface can fit snugly around the circumference of a can, each member being cylindrical over substantially its entire length and sized so that its length is no longer than the length of a can, and further designed so that when detached from said other members, each member is capable of lengthwise telescopic movement along the outer periphery of its associated can so as to extend beyond the top rim of a can and define a drinking cup large enough to accommodate a volume of liquid to be drunk while said member remains attached to said can;

means for connecting said members to each other at their top surfaces and at the top of the associated cans such that the entire length of each of said members rests flush on the outer surface of its associated can by means of frictional forces exerted both on the external surface of the can and on the top rim of the can and in parallel rows to form a carrier device;

means for detaching said members from each other; and means for carrying said device.

2. The combination beverage can carrier device and drinking accessory according to claim 1 wherein said device is made of plastic.

3. The combination beverage can carrier device and drinking accessory according to claim 1 wherein said carrier device comprises six members connected in two parallel rows of three members.

4. The combination beverage can carrier device and drinking accessory according to claim 1 wherein said members are sized to be used in connection with twelve ounce cans.

5. The combination beverage can carrier device and drinking accessory according to claim 1 wherein said members are disposable.

6. The combination beverage can carrier device and drinking accessory according to claim 1 wherein said connecting means and said detaching means define an integral element of the same material.

7. The combination beverage can carrier device and drinking accessory according to claim 6 wherein said element is plastic with areas of weakness between respective extension members.

8. The combination beverage can carrier device and drinking accessory according to claim 1 wherein said members are connected to each other at regions along the upper outer surfaces of said members.

9. The combination beverage can carrier device and drinking accessory according to claim 1 wherein the length of each member is sized so that when said member is extended beyond the top surface of a can, the area formed by the top of the can and said member is large enough to accommodate external additive elements, such as ice cubes.

* * * * *